US012188167B2

(12) United States Patent
Yoneda et al.

(10) Patent No.: US 12,188,167 B2
(45) Date of Patent: Jan. 7, 2025

(54) OPERATION ANALYSIS METHOD, RECORDING MEDIUM, OPERATION ANALYSIS SYSTEM, AND PRESENTATION DEVICE

(71) Applicant: Panasonic Intellectual Property Management Co., Ltd., Osaka (JP)

(72) Inventors: Yuka Yoneda, Hyogo (JP); Ryo Nishimura, Osaka (JP); Mariko Nakaso, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 449 days.

(21) Appl. No.: 17/774,382

(22) PCT Filed: Jun. 29, 2021

(86) PCT No.: PCT/JP2021/024633
§ 371 (c)(1),
(2) Date: May 4, 2022

(87) PCT Pub. No.: WO2022/180880
PCT Pub. Date: Sep. 1, 2022

(65) Prior Publication Data

US 2023/0160127 A1 May 25, 2023

(30) Foreign Application Priority Data

Feb. 25, 2021 (JP) ..... 2021-029306

(51) Int. Cl.
*D06F 34/28* (2020.01)
*D06F 33/30* (2020.01)
(Continued)

(52) U.S. Cl.
CPC ..... *D06F 34/28* (2020.02); *D06F 33/30* (2020.02); *D06F 34/05* (2020.02); *D06F 2103/68* (2020.02); *D06F 2105/52* (2020.02)

(58) Field of Classification Search
CPC ..... D06F 34/28; D06F 2105/52; D06F 33/30; D06F 2103/68; D06F 34/05
See application file for complete search history.

(56) References Cited

U.S. PATENT DOCUMENTS

2018/0191518 A1 7/2018 Shu et al.
2020/0258029 A1* 8/2020 Jung ..... G06N 3/08

FOREIGN PATENT DOCUMENTS

CN 112323343 A * 2/2021
JP 2012130379 A * 7/2012
(Continued)

OTHER PUBLICATIONS

Machine Translation of WO-2014192214-A1 to Aso, Dec. 2014 (Year: 2014).*
(Continued)

*Primary Examiner* — Benjamin L Osterhout
(74) *Attorney, Agent, or Firm* — Rimon P.C.

(57) ABSTRACT

An operation analysis method includes a first acquisition step, a second acquisition step, a plan designing step, and an analysis step. In the first acquisition step, the operation history of a washer is acquired. In the second acquisition step, at least the action schedule of a user of the washer is acquired. In the plan designing step, based on the operation history acquired in the first acquisition step, an operation plan for the future regarding the normal operation of the washer periodically performed by the user is designed. In the analysis step, based on the action schedule acquired in the second acquisition step, whether the operation of the washer is the normal operation is analyzed. In the plan designing
(Continued)

step, the operation plan is updated based on the result of the analysis in analysis step.

12 Claims, 8 Drawing Sheets

(51) Int. Cl.

| | |
|---|---|
| *D06F 34/05* | (2020.01) |
| *D06F 103/68* | (2020.01) |
| *D06F 105/52* | (2020.01) |

(56) References Cited

FOREIGN PATENT DOCUMENTS

| | | | | | |
|---|---|---|---|---|---|
| JP | 2018-521743 | A | | 11/2015 | |
| JP | 2017134635 | A | * | 8/2017 | |
| JP | 2019076627 | A | * | 5/2019 | ..... D06F 34/05 |
| KR | 20150118749 | A | * | 10/2015 | |
| WO | WO-2014192214 | A1 | * | 12/2014 | ..... G06F 16/24578 |

OTHER PUBLICATIONS

Machine Translation of KR-20150118749-A to Hong et al., Oct. 2015. (Year: 2015).*
Machine Translation of JP-2019076627-A to Akiyoshi, May 2019. (Year: 2019).*
Machine Translation of JP-2017134635-A to Yoshioka, Aug. 2017. (Year: 2017).*
Machine Translation of JP-2012130379-A to Ban, Jul. 2012. (Year: 2012).*
Machine Translation of CN-112323343-A to Deng, Feb. 2021. (Year: 2021).*
International Search Report issued on Aug. 31, 2021 in International Patent Application No. PCT/JP2021/024633.

* cited by examiner

OPERATION ANALYSIS METHOD, RECORDING MEDIUM, OPERATION ANALYSIS SYSTEM, AND PRESENTATION DEVICE

CROSS-REFERENCE OF RELATED APPLICATIONS

This application is the U.S. National Phase under 35 U.S.C. § 371 of International Patent Application No. PCT/JP2021/024633, filed on Jun. 29, 2021, which in turn claims the benefit of Japanese Patent Application No. 2021-029306, filed on Feb. 25, 2021, the entire disclosures of which Applications are incorporated by reference herein.

TECHNICAL FIELD

The present disclosure relates to an operation analysis method for analyzing the operation of a washer, a recording medium, an operation analysis system, and a presentation device.

BACKGROUND ART

Patent Literature (PTL) 1 discloses an intelligent clothes washing control system. This system includes at least a washing program module which is incorporated in an intelligent terminal, an acquisition module, a processing module, a recommendation module, a communication module, and a server which is incorporated in a cloud. The terminal described above is connected to the server to communicate therewith. The washing program module includes at least one washing program. The acquisition module acquires the washing records of the washing program. The processing module transmits the washing records to the server which performs analysis. The server analyzes the washing records, further utilizes big data, obtains a washing proposal suitable for the washing records, and transmits it to the recommendation module. The recommendation module displays, on a terminal interface, the washing proposal transmitted by the server.

CITATION LIST

Patent Literature

[PTL 1] Japanese Unexamined Patent Application Publication (Translation of PCT Application) No. 2018-521743

SUMMARY OF INVENTION

Technical Problem

The present disclosure provides an operation analysis method in which the aspect of the operation of a washer performed by a user is easily grasped and the like.

Solution to Problem

An operation analysis method according to an aspect of the present disclosure includes a first acquisition step, a second acquisition step, a plan designing step, and an analysis step. In the first acquisition step, the operation history of a washer is acquired. In the second acquisition step, at least an action schedule of a user of the washer is acquired. In the plan designing step, based on the operation history acquired in the first acquisition step, an operation plan for future regarding a normal operation of the washer periodically performed by the user is designed. In the analysis step, based on the action schedule acquired in the second acquisition step, whether the operation of the washer is the normal operation is analyzed. The plan designing step includes updating the operation plan based on the result of analysis in the analysis step.

An operation analysis method according to an aspect of the present disclosure includes a first acquisition step, a plan designing step, and an analysis step. In the first acquisition step, the operation history of a washer is acquired. In the plan designing step, based on the operation history acquired in the first acquisition step, an operation plan for future regarding a normal operation of the washer periodically performed by the user is designed. In the analysis step, based on at least an action schedule of the user of the washer, whether the operation of the washer is the normal operation is analyzed. The plan designing step includes updating the operation plan based on the result of analysis in the analysis step.

A recording medium according to an aspect of the present disclosure is a non-transitory computer-readable recording medium having a program recorded thereon for causing one or more processors to execute the operation analysis method described above.

An operation analysis system according to an aspect of the present disclosure includes a first acquirer, a second acquirer, a planner, and an analyzer. The first acquirer acquires an operation history of a washer. The second acquirer acquires at least an action schedule of a user of the washer. The planner designs, based on the operation history acquired by the first acquirer, an operation plan for future regarding a normal operation of the washer periodically performed by the user. The analyzer analyzes, based on the action schedule acquired by the second acquirer, whether the operation of the washer is the normal operation. The planner updates the operation plan based on the result of analysis performed by the analyzer.

A presentation device according to an aspect of the present disclosure includes a communication function and a presentation function. The communication function is a function of communicating with the operation analysis system described above. The presentation function is a function of presenting, when signals including the operation plan designed by the planner and the action schedule acquired by the second acquirer are received through the communication function, the operation plan and the action schedule to the user.

Advantageous Effects of Invention

In an operation analysis method and the like according to the present disclosure, it is advantageous to easily grasp the aspect of the operation of a washer performed by a user.

Figure 1:
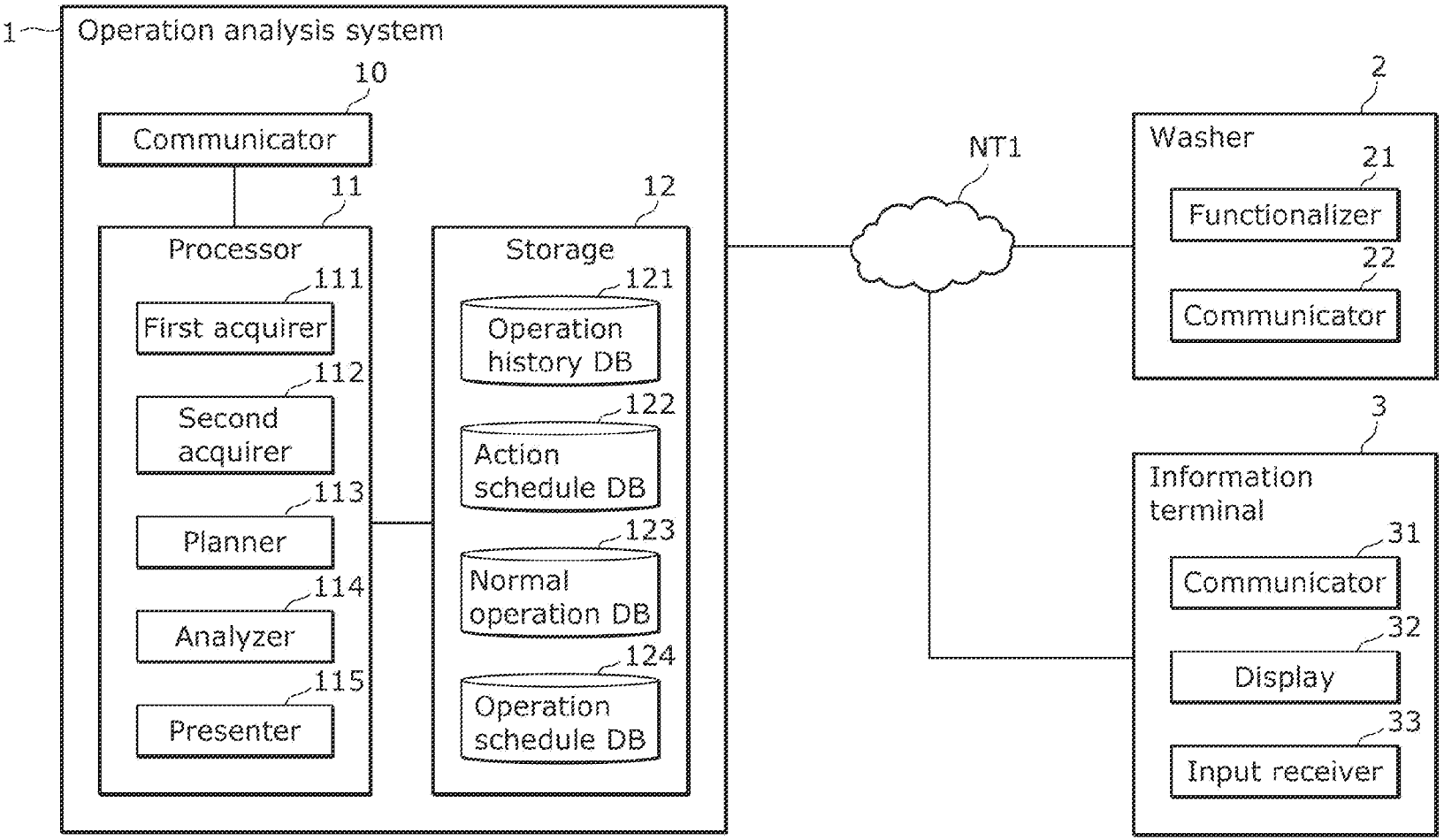
FIG. 1 is a block diagram showing an overall configuration including an operation analysis system in an embodiment.

DESCRIPTION OF EMBODIMENTS (Findings Underlying Present Disclosure)

The inventor's point of view will first be described below.

For example, the intelligent clothes washing control system disclosed in PTL 1 analyzes the washing records of the washing program, further utilizes big data, thereby generates the washing proposal suitable for a user, and displays the generated washing proposal on a terminal possessed by the user. It can be expected that the user sees the washing proposal displayed on the terminal to perform the operation of the washer suitable for the user without considering an operation mode and the like of the washer.

Incidentally, the operation of the washer can include not only a normal operation which is periodically performed by the user but also a temporary operation which is irregularly performed by the user. The normal operation can include, for example, an operation of the washer which is performed during a predetermined time of day. The normal operation can include, for example, an operation for washing clothes of a child after the child plays soccer every Thursday. In other words, the normal operation is the operation of the washer which is periodically performed. On the other hand, the temporary operation can include, for example, an operation for washing, after the user comes back from a trip, clothes used during the trip. The temporary operation can include, for example, an operation for washing, after an athletic meet of the child, clothes of the child. In other words, the temporary operation is the operation of the washer which can occur after an irregular action of the user or a family member of the user and which is not periodically performed.

Here, in the intelligent clothes washing control system disclosed in PTL 1, when the washing records are analyzed, whether the past operations of the washer are the normal operations is not analyzed. In other words, in the system, the aspect of the operation of the washer performed by the user is not grasped. Hence, in the system, the washing records including the temporary operation are analyzed, and thus the washing proposal for the user is unlikely to be a proposal for the operation (that is, the normal operation) of the washer suitable for the user, with the result that the convenience of the user may be lowered.

In view of the foregoing, the inventor has completed the present disclosure.

An embodiment will be described in detail below with reference to drawings as necessary. However, a detailed description beyond necessity may be omitted. For example, a detailed description of an already well known matter or a repeated description of substantially the same configuration may be omitted. This is intended for preventing the following description from being unnecessarily redundant and facilitating the understanding of a person skilled in the art.

The inventor provides accompanying drawings and the following description so that the person skilled in the art fully understands the present disclosure, and they do not intend to limit the scope of claims.

Embodiment

[1-1. Overall Configuration]

An overall configuration including operation analysis system 1 in the embodiment will first be described with reference to FIG. 1. FIG. 1 is a block diagram showing the overall configuration including operation analysis system 1 in the embodiment. In the embodiment, operation analysis system 1 is used to analyze the operation of drying function-equipped washer 2 (hereinafter simply referred to as "washer 2" unless otherwise specified). In other words, in the embodiment, the operation of washer 2 includes at least a washing operation for washing clothes, and can include a drying operation for drying clothes.

Washer 2 includes functionalizer 21 and communicator 22. In the embodiment, washer 2 is a drum-type washer which serves as an example. Washer 2 may naturally be, for example, a vertical washer or the like without being limited to the drum-type washer.

Functionalizer 21 performs various types of functions included in washer 2. In the embodiment, functionalizer 21 includes a washing function of performing a washing operation for washing clothes stored in a washing tub and a drying function of performing a drying operation for drying the clothes stored and washed in the washing tub. In the washing operation, for example, the washing tub is rotated to perform washing, rinsing, and/or dehydrating, and the like on the clothes stored in the washing tub so as to wash the clothes. In the drying operation, for example, dry air dehumidified by a heat pump is fed to dry the clothes stored and washed in the washing tub.

Functionalizer 21 performs, for example, a function corresponding to an input of the user received by a user interface incorporated in washer 2. Functionalizer 21 communicates, for example, with information terminal 3 possessed by the user via communicator 22 to perform a function corresponding to an input of the user received by information terminal 3.

Communicator 22 communicates, for example, with communicator 10 in operation analysis system 1 via external network NT1 such as the Internet. The communication between communicator 22 and communicator 10 in operation analysis system 1 may be wireless communication or wired communication. The standards of the communication between communicator 22 and operation analysis system 1 are not particularly limited. Communicator 22 also communicates with information terminal 3 as described above.

In the embodiment, washer 2 transmits, via communicator 22, to operation analysis system 1, signals including an operation history stored in a memory incorporated in washer 2. The operation history is the history of operations performed by washer 2 in the past, and can include not only the history of a normal operation but also the history of a temporary operation. The operation history does not include data as to whether an operation performed by washer 2 in the past is the normal operation.

As described above, information terminal 3 is a terminal possessed by the user, and examples of information terminal 3 can include a smartphone, a tablet terminal, a desktop or laptop personal computer, and the like. In the embodiment, information terminal 3 is a smartphone. Information terminal 3 includes communicator 31, display 32, and input receiver 33.

Communicator 31 includes a function of communicating with communicator 22 in washer 2 and a function of communicating with communicator 10 in operation analysis system 1. The communication between information terminal 31 and communicator 22 in washer 2 is, for example, wireless communication in accordance with standards such as WiFi (registered trademark) or Bluetooth (registered trademark) Low Energy (BLE). The standards for the communication between information terminal 31 and communicator 22 in washer 2 are not particularly limited. The communication between communicator 31 and communicator 10 in operation analysis system 1 may be wireless communication performed via external network NT1 or wired communication. The standards for the communication between communicator 31 and communicator 10 in operation analysis system 1 are not particularly limited.

Display 32 is, for example, a liquid crystal display, and displays various types of information. In the embodiment, display 32 displays an operation plan of washer 2 which is received by communicator 31 from operation analysis system 1. The details of the operation plan of washer 2 will be described later.

Input receiver 33 receives an input made by an operation of the user. Input receiver 33 receives, for example, an input for approving the operation plan displayed on display 32, an input for revising the operation plan, and the like. In the embodiment, display 32 is formed with a touch panel. Hence, in the embodiment, display 32 also serves as input receiver 33.

[1-2. Operation Analysis System]

The details of operation analysis system 1 will then be described. In the embodiment, operation analysis system 1 is formed with, for example, a server which is installed in a remote location away from a facility (here, a house where the user lives) where washer 2 is installed. Although in the embodiment, a description will be given on the assumption that one washer 2 is targeted in operation analysis system 1, a plurality of washers 2 may be targeted in operation analysis system 1. As shown in FIG. 1, operation analysis system 1 includes communicator 10, processor 11, and storage 12.

As has already been described, communicator 10 includes the function of communicating with communicator 22 in washer 2 via external network NT1. As has already been described, communicator 10 also includes the function of communicating with communicator 31 in information terminal 3 via external network NT1.

Processor 11 includes a processor and a memory, and the processor executes programs stored in the memory to achieve various functions. Processor 11 includes functions of performing first acquirer 111, second acquirer 112, planner 113, analyzer 114, and presenter 115. In other words, operation analysis system 1 includes first acquirer 111, second acquirer 112, planner 113, analyzer 114, and presenter 115. Presenter 115 does not need to be included in the constituent elements of operation analysis system 1.

First acquirer 111 acquires the operation history of washer 2. First acquirer 111 is the main constituent which performs first acquisition step ST1 in an operation analysis method. In the embodiment, first acquirer 111 acquires, via communicator 10, the operation history which is transmitted from washer 2 by requesting washer 2 or is periodically transmitted from washer 2. The operation history includes the types of operation of washer 2 (the washing operation and/or the drying operation), dates and times when the operation is performed (such as an operation start time, an operation completion time, and a reservation completion time), and operation parameters. Examples of the operation parameter can include, for example, when the washing operation is performed, a course (such as a washing course), a washing amount, a washing time (an actual working time and an estimated time), a dehydration time, the number of repetitions of dehydration, a rinse time, the number of times rinsing is performed, whether a detergent is automatically added, the amount of detergent added, whether a softener is automatically added, the amount of softener added, whether bath water is used, the temperature of water used for the washing operation, whether the washing operation and the drying operation are switched, and the like. The operation history acquired by first acquirer 111 is stored in operation history DB (database) 121 of storage 12 which will be described later.

Second acquirer 112 acquires at least the action schedule of the user of washer 2. Second acquirer 112 is the main constituent which performs second acquisition step ST2 in the operation analysis method. In the embodiment, the action schedule is managed by a schedule management application installed in information terminal 3, and can include not only the schedule of the user but also the schedules of the family members of the user. The action schedule includes at least an action start date and time of the user, an action completion date and time of the user, and an overview of the action of the user. The overview of the action of the user preferably includes information indicating whether the user is at home or out during the action of the user, and does not need to include the specific details of the action. Second acquirer 112 acquires, via communicator 10, the action schedule which is transmitted from information terminal 3 by requesting information terminal 3 or is periodically transmitted from information terminal 3. The action schedule acquired by second acquirer 112 is stored in action schedule DB 122 of storage 12 which will be described later.

For example, when the action schedule is managed by a schedule management server, second acquirer 112 may acquire, via communicator 10, the action schedule which is transmitted from the server by requesting not information terminal 3 but the server or is periodically transmitted from the server.

Planner 113 designs, based on the operation history acquired by first acquirer 111 (first acquisition step ST1), an operation plan for the future regarding the normal operation of washer 2 which is periodically performed by the user. Planner 113 is the main constituent which performs plan designing step ST3 in the operation analysis method. In the embodiment, it is assumed that washer 2 automatically performs the normal operation at a time set in the operation plan. Hence, the operation plan includes a time of day during which washer 2 performs the operation. In the embodiment, planner 113 designs the operation plan on the normal operation of washer 2 in a predetermined period (for example, one week). In one example, when the operation plan is designed on Sunday, planner 113 designs the operation plan which includes the start time, the completion time, and the operation parameters for the normal operation of washer 2 on each day from Monday to Sunday of the next week.

In the embodiment, planner 113 performs statistical processing as necessary on the operation history stored in operation history DB 121 of storage 12 to design the operation plan. In one example, a brief description will be given of a process in which planner 113 designs an operation plan for Monday of every week. The process described below is performed on each day of the week. Planner 113 first read, from the operation history stored in operation history DB 121, an operation history of washer 2 performed on Mondays. Then, planner 113 calculates, based on the operation history which is read, a typical value (such as an average value, a median value, or a mode value) of operation parameters, and determines the calculated typical value as the operation parameter for the normal operation which is performed every Monday. For example, when operation parameters include the number of times rinsing is performed, the mode value of the number of times rinsing is performed is determined as the number of times rinsing is performed in the normal operation performed every Monday.

The operation plan designed by planner 113 is stored in normal operation DB 123 of storage 12 which will be described later. As described later, depending on the result of analysis performed by analyzer 114, planner 113 updates the operation plan stored in normal operation DB 123 of storage 12.

Planner 113 may design, for example, an operation plan for a plurality of days such as one week or may design an operation plan for the next day (that is, for one day). Planner 113 may design an operation plan for subsequent days after the day when the operation plan is designed or may design an operation plan for several hours ahead in the day when the operation plan is designed.

Analyzer 114 analyzes, based on the action schedule acquired by second acquirer 112 (second acquisition step ST2), whether the operation of washer 2 is the normal operation. Analyzer 114 is the main constituent which performs analysis step ST4 in the operation analysis method. In the embodiment, analyzer 114 (analysis step ST4) analyzes, based on the result of a revision made by the user to the operation plan presented by presenter 115 (presentation step ST5) which will be described later, whether the operation of washer 2 is the normal operation. One example of this analysis will be described in detail in [1-4. Example of analysis and update] discussed later.

Analyzer 114 references, for example, the operation history acquired by first acquirer 111 and the action schedule acquired by second acquirer 112, and thereby analyzes that the operation of washer 2 which is performed after an irregular action (such as an athletic meet of a child or a trip) in the action schedule of the user is the temporary operation. This analysis can be performed without the operation plan and the action schedule being presented to the user.

Then, planner 113 updates the operation plan based on the result of the analysis performed by analyzer 114 (analysis step ST4). For example, when the operation of washer 2 which is planned as the normal operation in the operation plan is deleted by the user, planner 113 updates the operation plan according to the result of the analysis performed by analyzer 114 on the operation of washer 2 described above. For example, when the operation of washer 2 which is planned as the normal operation in the operation plan is analyzed to be the temporary operation by analyzer 114, planner 113 updates the operation plan such that the operation of washer 2 described above is excluded. One example of the update of the operation plan will be described in detail in [1-4. Example of analysis and update] discussed later.

Presenter 115 presents, to the user, the operation plan designed by planner 113 (plan designing step ST3) and the action schedule acquired by second acquirer 112 (ST2). Presenter 115 is the main constitute which performs presentation step ST5 in the operation analysis method. Specifically, presenter 115 reads the operation plan stored in operation schedule DB 124 of storage 12 which will be described later and the action schedule stored in action schedule DB 122, and transmits, via communicator 10, to information terminal 3, signals including schedule information obtained by combining the operation plan and the action schedule. When in information terminal 3, the signals are received in communicator 31, the schedule information included in the signals is displayed on display 32. In this way, the schedule in which the operation plan and the action schedule are combined together is presented to the user.

In the embodiment, the operation plan presented by presenter 115 is an actual operation plan which will be described later, that is, an operation plan in which the actual date and time is reflected on the operation plan designed by planner 113.

In the embodiment, as has already been described, planner 113 designs the operation plan on the normal operation of washer 2 in the predetermined period (for example, one week). Hence, in the embodiment, presenter 115 presents the operation plan and the action schedule in the predetermined period to the user. In the embodiment, for example, as shown in FIGS. 2 to 5, presenter 115 displays the operation plan and the action schedule as a calendar format image on display 32 to present the operation plan and the action schedule to the user. When planner 113 designs an operation plan for the next day (that is, for one day), presenter 115 presents the operation plan and the action schedule for the next day to the user.

Storage 12 is a storage device which stores information (such as computer programs) necessary for performing various types of functions by the units of processor 11. Although storage 12 is realized by, for example, a semiconductor memory, storage 12 is not particularly limited, and a known means for electronic information storage can be used. Storage 12 includes operation history DB 121, action schedule DB 122, normal operation DB 123, and operation schedule DB 124.

In operation history DB 121, the operation history acquired by first acquirer 111 is stored. In action schedule DB 122, the action schedule acquired by second acquirer 112 is stored. In normal operation DB 123, the operation plan designed by planner 113 is stored. The operation plan stored in normal operation DB 123 is not associated with the actual date and time. In operation schedule DB 124, the operation plan (hereinafter also referred to as the "actual operation plan") in which the actual date and time is reflected on the operation plan stored in normal operation DB 123 is stored. For example, it is assumed that the day when planner 113 designs an operation plan for one week is December 1st (Sun.). In this case, in operation schedule DB 124, an actual operation plan from December 2nd (Mon.) to December 7th (Sun.) is stored.

[1-4. Example of Analysis and Update]

Figure 2:
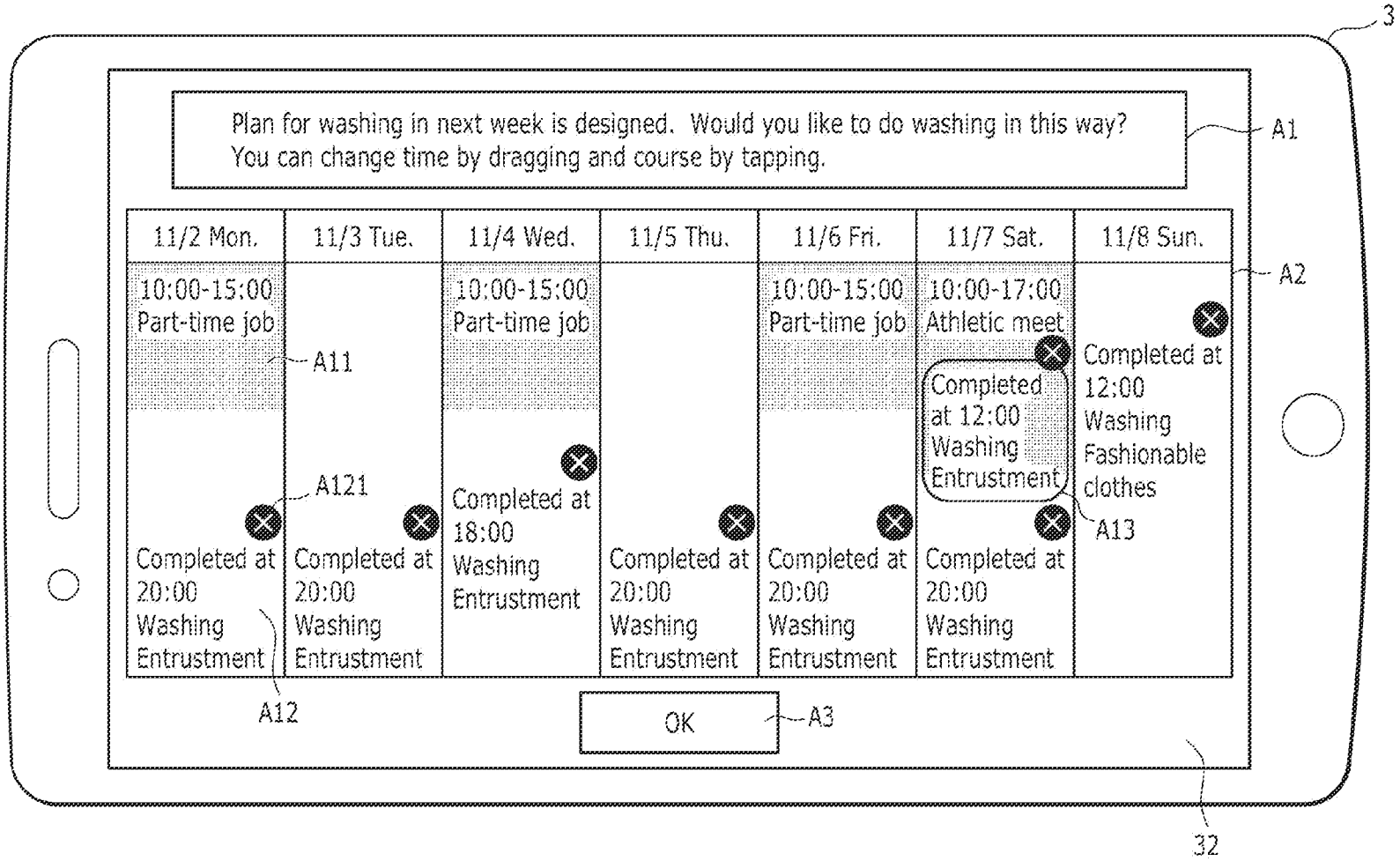
FIG. 2 is a diagram showing a first display example of an actual operation plan and an action schedule in an information terminal in the embodiment.
Figure 3:
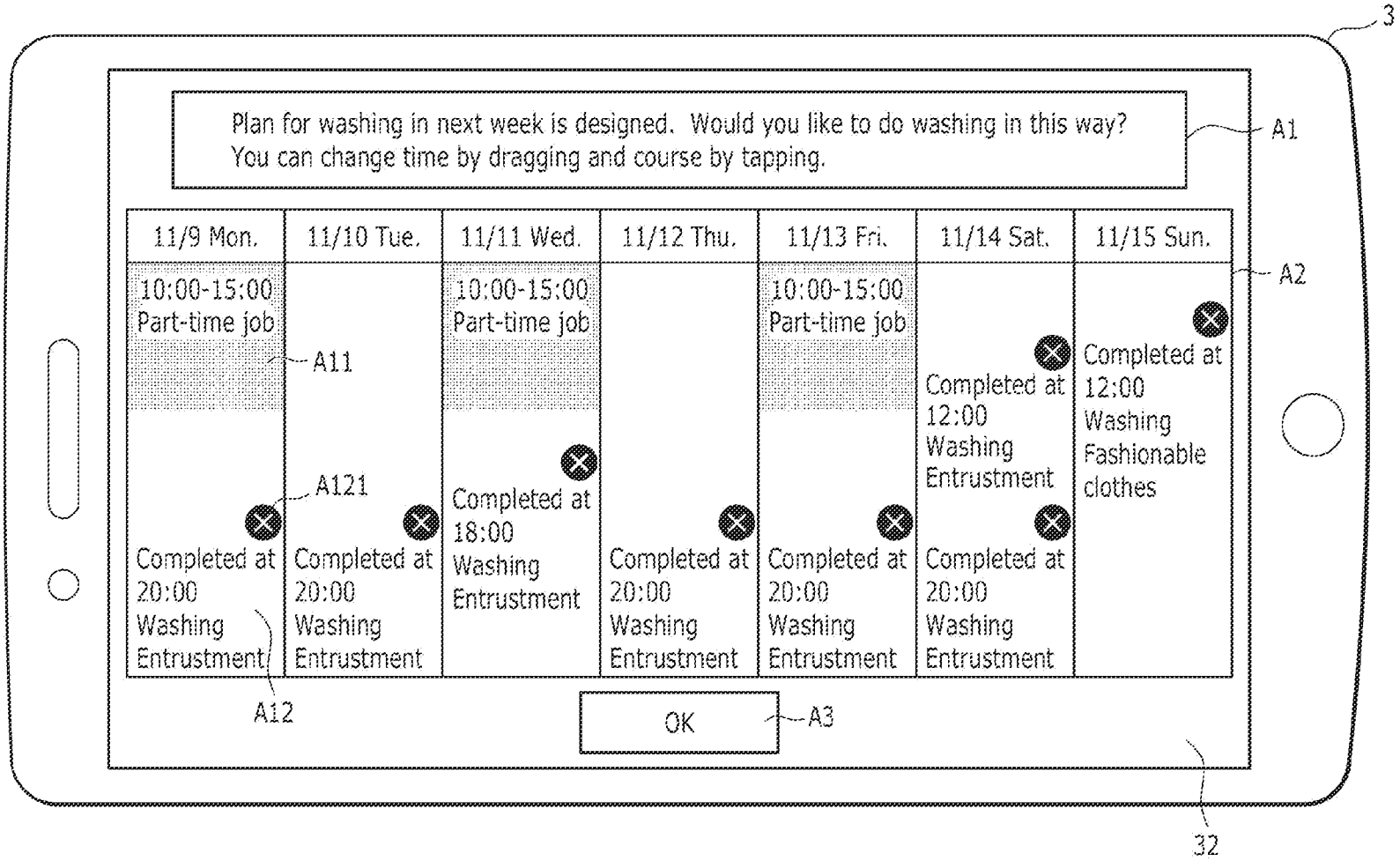
FIG. 3 is a diagram showing a second display example of the actual operation plan and the action schedule in the information terminal in the embodiment.
Figure 4:
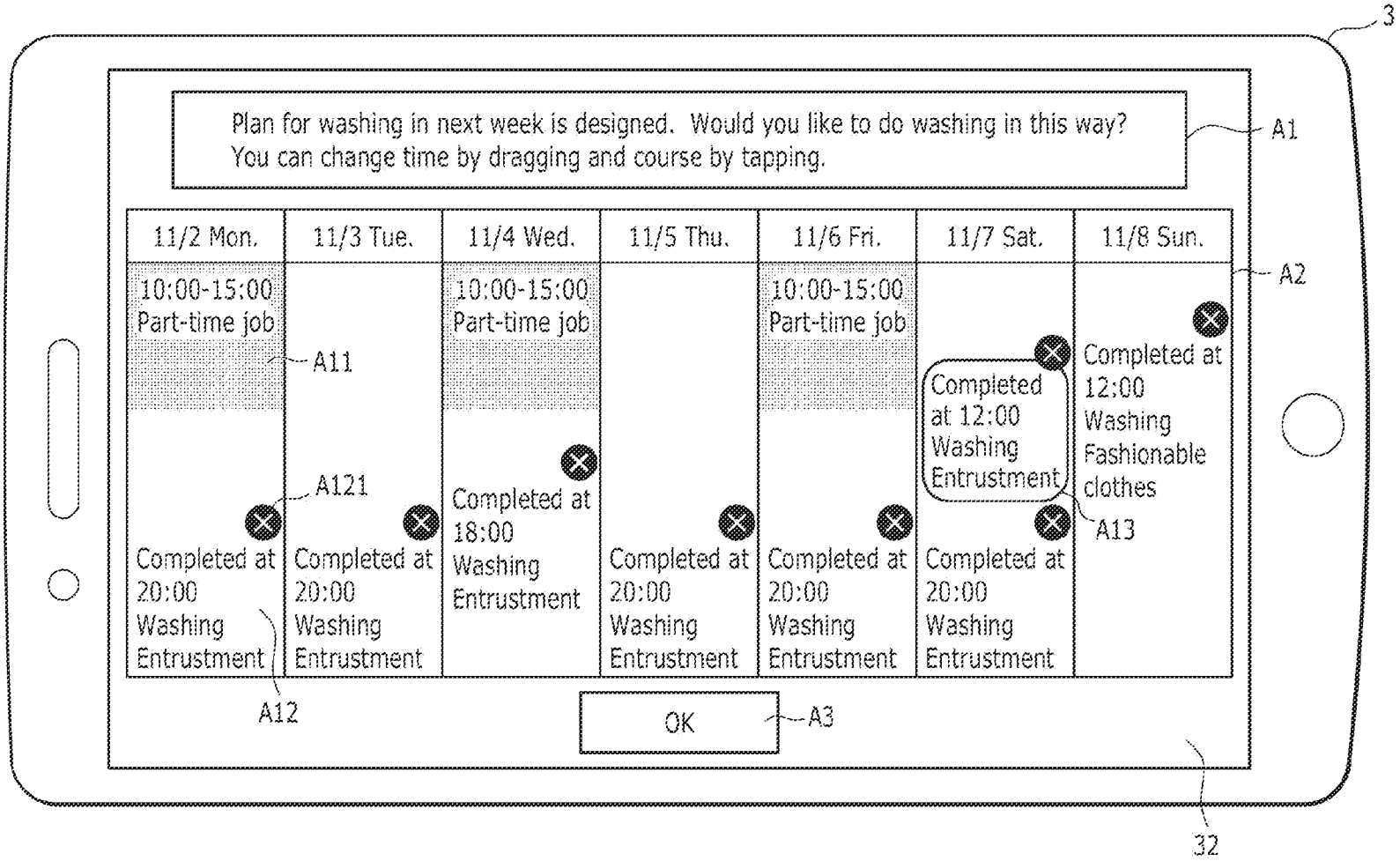
FIG. 4 is a diagram showing a third display example of the actual operation plan and the action schedule in the information terminal in the embodiment.
Figure 5:
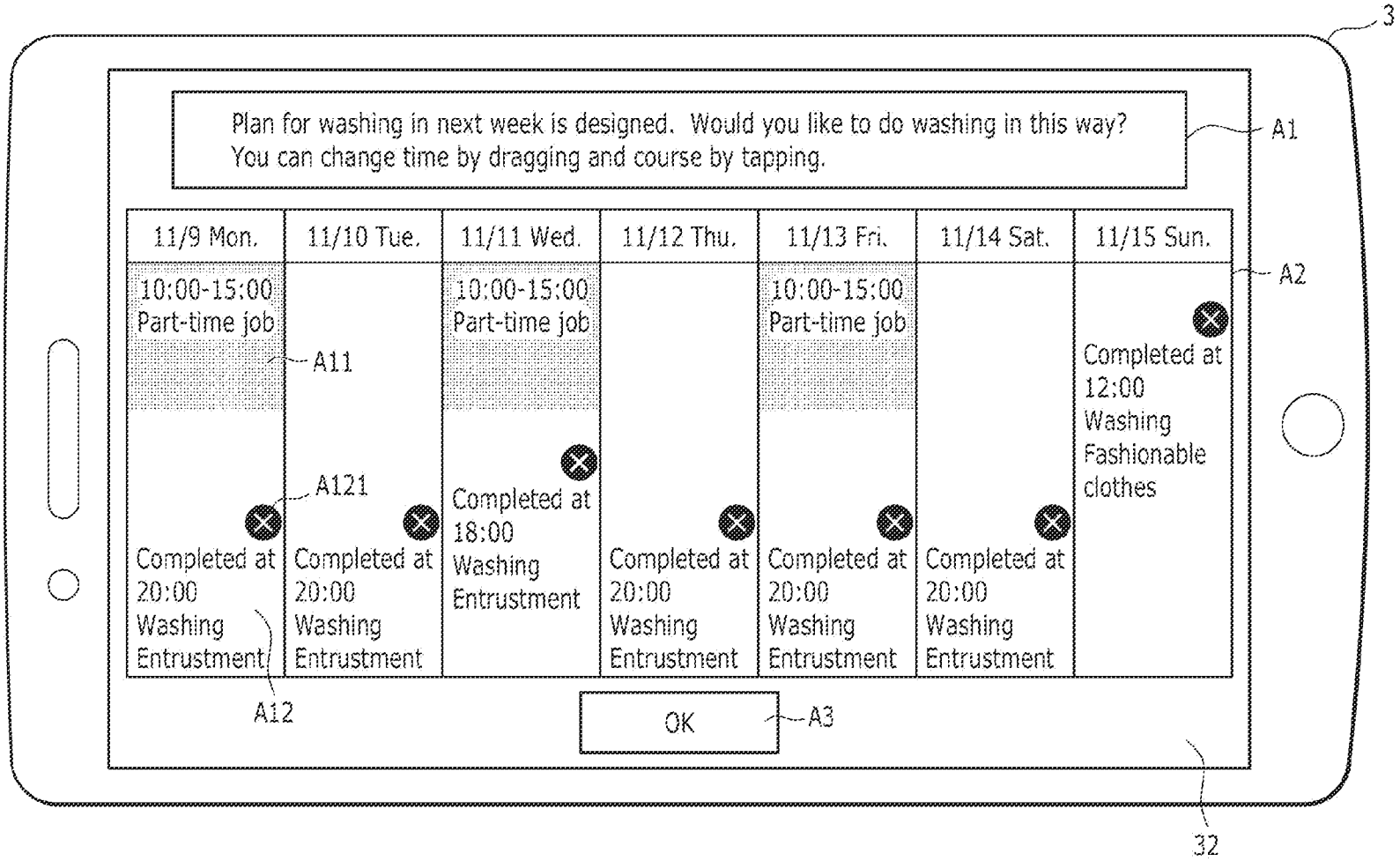
FIG. 5 is a diagram showing a fourth display example of the actual operation plan and the action schedule in the information terminal in the embodiment.

One example of the analysis performed by analyzer 114 and the update of the actual operation plan performed by planner 113 will be described below with reference to FIGS. 2 to 5. FIG. 2 is a diagram showing a first display example of the actual operation plan and the action schedule in information terminal 3 in the embodiment. FIG. 3 is a diagram showing a second display example of the actual operation plan and the action schedule in information terminal 3 in the embodiment. FIG. 4 is a diagram showing a third display example of the actual operation plan and the action schedule in information terminal 3 in the embodiment. FIG. 5 is a diagram showing a fourth display example of the actual operation plan and the action schedule in information terminal 3 in the embodiment.

In each of the first display example and the third display example shown in FIGS. 2 and 4, the actual operation plan and the action schedule for one week (here, one week from November 2nd (Mon.) to November 8th (Sun.)) are displayed on display 32 in a calendar format. In each of the second display example and the fourth display example shown in FIGS. 3 and 5, the actual operation plan and the action schedule for one week (here, one week from November 9th (Mon.) to November 15th (Sun.)) are displayed on display 32 in a calendar format. In each of the first to fourth display examples, first region A1, second region A2, and third region A3 are displayed on display 32. In first region A1, a message for prompting the user to approve or revise the actual operation plan is displayed. In second region A2, a schedule including the actual operation plan and the action schedule is displayed. In third region A3, an icon for receiving an operation of approving the actual operation plan is displayed.

In second region A2, the action schedule of the user is displayed in region A11. For example, as shown in FIG. 2, on November 2nd (Mon.), in region A11, "10:00" indicating the action start time of the user, "15:00" indicating the action completion time of the user, and a character string "part-time job" indicating an overview of the action of the user are displayed. In second region A2, the actual operation plan is displayed in region A12. For example, as shown in FIG. 2, on November 2nd (Mon.), in region A12, "completed at 20:00" indicating the completion time of the operation of washer 2, "washing" indicating the type of operation of washer 2, and a character string "entrustment" indicating the details of the operation of washer 2 are displayed. In an upper right end of region A12, an x mark icon A121 is displayed.

For example, the user touches region A12 with a fingertip to perform an operation, and thereby can revise the actual operation plan. For example, the user taps icon A121 in any one of regions A12 to be able to delete, from the actual operation plan, the operation of washer 2 corresponding to region A12 described above. For example, the user taps any one of regions A12 to be able to change the details of the operation of washer 2 corresponding to region A12 described above. For example, the user drags and moves any one of regions A12 to be able to change the completion time of the operation of washer 2 corresponding to region A12 described above. Then, the user taps the icon displayed in third region A3 to be able to approve the actual operation plan. Then, washer 2 performs the operation of washer 2 according to the actual operation plan approved by the user.

Here, it is assumed that as in the first display example shown in FIG. 2, planner 113 designs the operation plan and presenter 115 presents the actual operation plan and the action schedule to the user. As shown in FIG. 2, in the first display example, on November 7th (Sat.), "completed at 12:00, washing, entrustment" indicating the operation of washer 2 corresponding to region A13 overlaps "10:00-17:00, athletic meet" indicating the action schedule of the user. It is assumed that the user therefore deletes the operation of washer 2 corresponding to region A13 in order to prioritize the action schedule. In this case, analyzer 114 determines that, since the action schedule overlaps the normal operation, the user simply deletes the operation of washer 2, and analyzes that the operation of washer 2 which is deleted is still the normal operation.

Then, as in the second display example shown in FIG. 3, planner 113 designs the subsequent operation plan based on the result of the analysis performed by analyzer 114, and presenter 115 presents the subsequent actual operation plan and the subsequent action schedule to the user. Here, since analyzer 114 analyzes that the operation of washer 2 which is deleted is still the normal operation, planner 113 reflects it on the date and time in the next week without updating the operation plan for one week. Hence, as shown in FIG. 3, the actual operation plan is presented to the user such that on Saturday of the next week (November 14th), as on Saturday of the previous week (November 7th), "completed at 12:00, washing, entrustment" indicating the operation of washer 2 corresponding to region A13 is included in the actual operation plan.

On the other hand, it is assumed that as in the third display example shown in FIG. 4, planner 113 designs the operation plan and presenter 115 presents the actual operation plan and the action schedule to the user. As shown in FIG. 4, in the third display example, on November 7th (Sat.), "completed at 12:00, washing, entrustment" indicating the operation of washer 2 corresponding to region A13 does not overlap the action schedule of the user. However, it is assumed that the user thinks about stopping the washing of clothes in this time of day in the future, and thus deletes the operation of washer 2 corresponding to region A13. In this case, analyzer 114 determines that, although the action schedule does not overlap the normal operation, the user deletes the normal operation, and analyzes that the operation of washer 2 which is deleted is not the normal operation.

Then, as in the fourth display example shown in FIG. 5, planner 113 designs the subsequent operation plan based on the result of the analysis performed by analyzer 114, and presenter 115 presents the subsequent actual operation plan and the subsequent action schedule to the user. Here, since analyzer 114 analyzes that the operation of washer 2 which is deleted is not the normal operation, planner 113 updates the operation plan such that the operation of washer 2 corresponding to region A13 is excluded, and reflects the updated operation plan on the date and time in the next week. Hence, as shown in FIG. 5, the actual operation plan is presented to the user such that on Saturday of the next week (November 14th), unlike Saturday of the previous week (November 7th), "completed at 12:00, washing, entrustment" indicating the operation of washer 2 corresponding to region A13 is excluded from the actual operation plan.

When the user revises a time of day during which the operation of washer 2 is performed and/or the details of the operation though the operation does not overlap the action schedule, analyzer 114 analyzes that the operation of washer 2 which is revised is still the normal operation. In this case, planner 113 updates the operation plan according to the result of the revision made by the user. When the user newly adds an operation of washer 2, if the operation of washer 2 which is added is set to be performed after a periodical action of the user (such as "part-time job" shown in FIG. 2), analyzer 114 analyzes that the operation described above is a new normal operation. In this case, planner 113 updates the operation plan such that the operation plan includes the new normal operation. On the other hand, if the operation of washer 2 which is added is set to be performed after an irregular action of the user (such as "athletic meet" shown in FIG. 2), analyzer 114 analyzes that the operation described above is the temporary operation. In this case, planner 113 does not update the operation plan.

[2. Operation]

Figure 6:
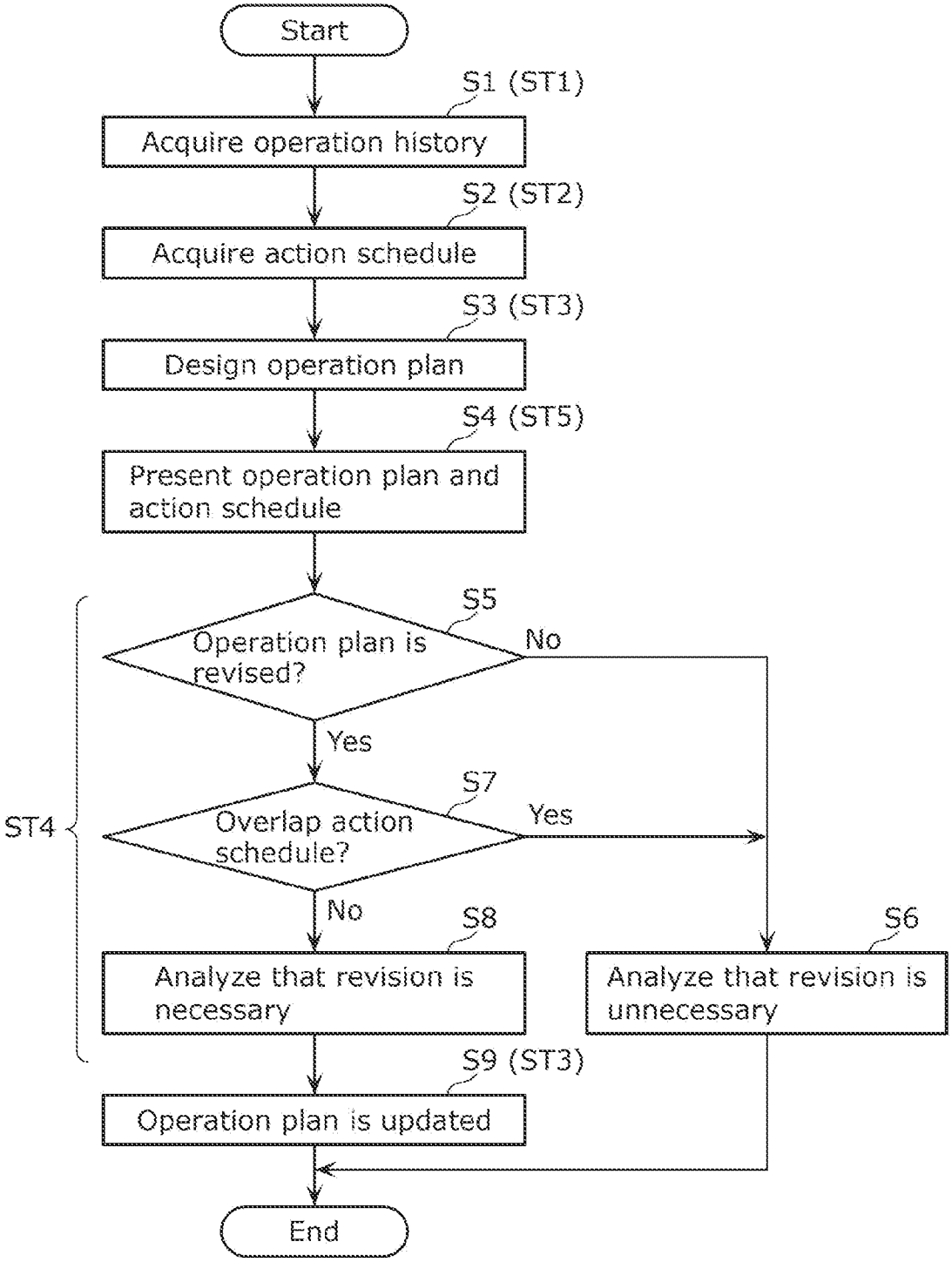
FIG. 6 is a flowchart showing an example of the operation of the operation analysis system in the embodiment.

The operation of operation analysis system 1 configured as described above will be described below with reference to FIG. 6. FIG. 6 is a flowchart showing an example of the operation of operation analysis system 1 in the embodiment. The flow of processing in which planner 113 designs an operation plan for one week and updates (or does not update) the operation plan according to the result of a revision made by the user to the designed operation plan will be described below. Here, the revision made by the user is assumed to be that the user deletes the operation of washer 2. In the following discussion, the description of processing for storing data in the individual databases of storage 12 and the description of processing for reading data from the individual databases are omitted.

First acquirer 111 first acquires an operation history from washer 2 (S1). Processing S1 corresponds to first acquisition step ST1 in the operation analysis method. Then, second acquirer 112 acquires an action schedule of the user from information terminal 3 (S2). Processing S2 corresponds to second acquisition step ST2 in the operation analysis method. Processing S1 and S2 may be performed in a reverse order or may be performed simultaneously. Then, planner 113 designs an operation plan based on the operation history acquired by first acquirer 111 (S3). Processing S3 corresponds to plan designing step ST3 in the operation analysis method. Then, presenter 115 presents, to the user, the operation plan designed by planner 113 and the action schedule acquired by second acquirer 112 (S4). Processing S4 corresponds to presentation step ST5 in the operation analysis method.

Thereafter, the user revises the operation plan and approves the revised operation plan or approves the operation plan without revising it while seeing the operation plan and the action schedule displayed on display 32 of information terminal 3. When the user does not revise the operation plan (S5: no), analyzer 114 analyzes that the operation of washer 2 included in the operation plan is the normal operation and that it is not necessary to change the subsequent operation plan (S6). In this case, planner 113 does not update the subsequent operation plan. When the user revises the operation plan (S5: yes) and the operation of washer 2 which is revised overlaps the action schedule (S7: yes), analyzer 114 analyzes that the operation of washer 2 which is revised is the normal operation and that it is not necessary to change the subsequent operation plan (S6). In this case, planner 113 also does not update the subsequent operation plan.

On the other hand, when the user revises the operation plan (S5: yes) and the operation of washer 2 which is revised does not overlap the action schedule (S7: no), analyzer 114 analyzes that the operation of washer 2 which is revised is not the normal operation and that it is necessary to change the subsequent operation plan (S8). In this case, planner 113 updates the subsequent operation plan such that the operation of washer 2 which is revised is excluded (S9). Processing S4 to S8 corresponds to analysis step ST4 in the operation analysis method. Processing S9 corresponds to plan designing step ST3 in the operation analysis method.

[3. Effects and the Like]

Advantages of operation analysis system 1 in the embodiment will be described below.

As has already been described, in the intelligent clothes washing control system disclosed in PTL 1, when the washing records are analyzed, whether the past operations of the washer are the normal operations is not analyzed. Hence, in the system, the washing records including the temporary operation are analyzed, and thus the washing proposal for the user is unlikely to be a proposal for the operation (that is, the normal operation) of the washer suitable for the user, with the result that the convenience of the user may be lowered.

By contrast, in operation analysis system 1 of the embodiment, based on the action schedule of the user, whether the operation of washer 2 is the normal operation is analyzed. Hence, in operation analysis system 1 of the embodiment, it is advantageous to easily grasp the aspect of the operation of washer 2 performed by the user. In operation analysis system 1 of the embodiment, the result of the analysis is reflected on the operation plan. Therefore, advantageously, in operation analysis system 1 of the embodiment, for example, it is possible to design the operation plan such that the operation of washer 2 such as the temporary operation which is not the normal operation is excluded, and thus it is easy to propose the operation of washer 2 suitable for the user, with the result that it can be expected that the convenience of the user is enhanced.

[4. Variations]

As described above, as an example of the technology disclosed in the present application, the embodiment has been described. However, the technology in the present disclosure is not limited to the embodiment, and can be applied to embodiments obtained by performing change, replacement, addition, omission, and the like as necessary. The constituent elements described in the above embodiment can be combined to form new embodiments.

Hence, variations of the embodiment will be illustrated below.

Figure 7:
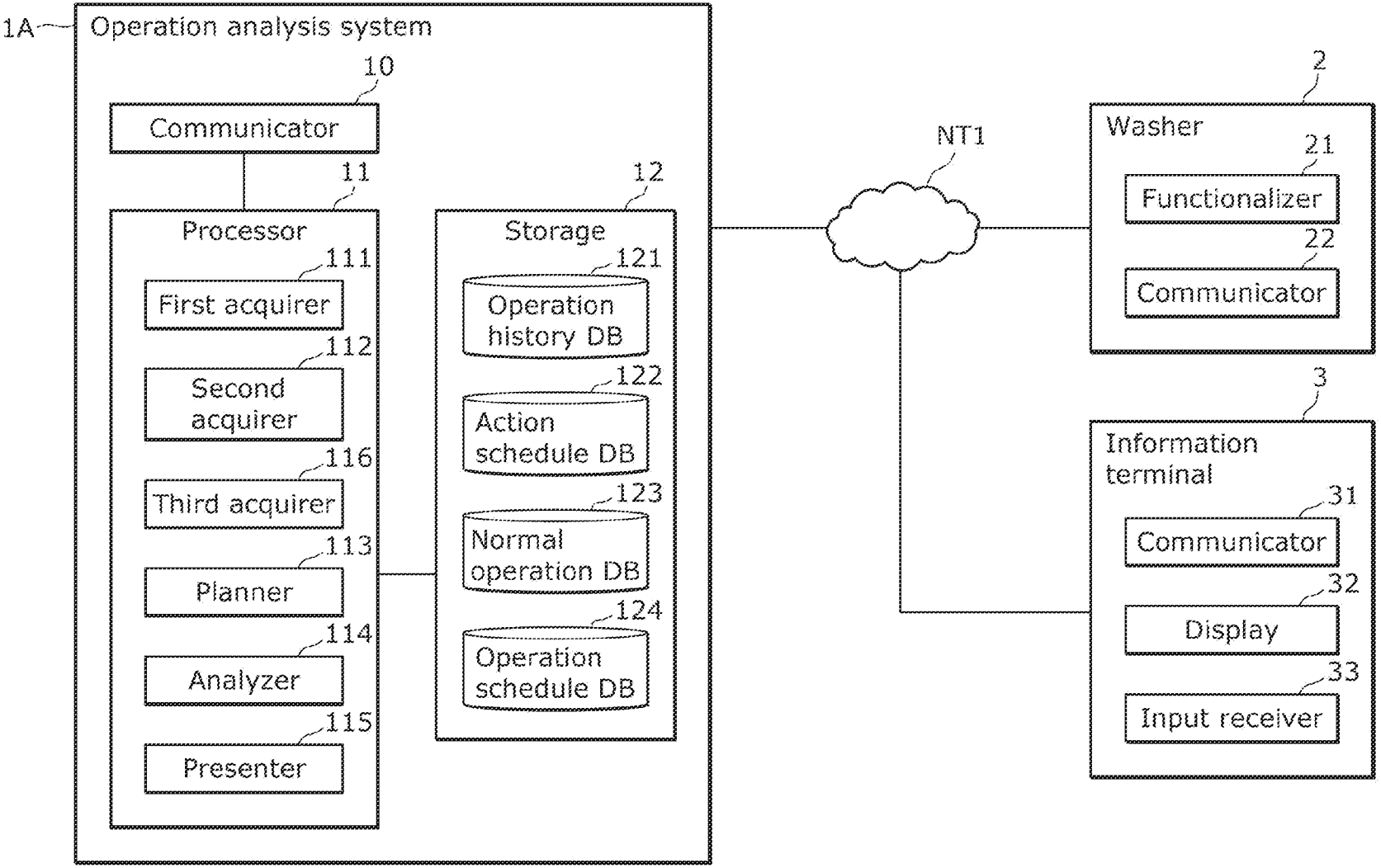
FIG. 7 is a block diagram showing an overall configuration including an operation analysis system in a variation of the embodiment.

In the embodiment described above, operation analysis system 1 may further acquire attribute information on the operation of washer 2. Operation analysis system 1A in a variation of the embodiment will be described below with reference to FIG. 7. FIG. 7 is a block diagram showing an overall configuration including operation analysis system 1A in the variation of the embodiment. As shown in FIG. 7, operation analysis system 1A in the present variation differs from operation analysis system 1 in the embodiment in that processor 11 further includes third acquirer 116.

Third acquirer 116 acquires attribute information on the operation of washer 2. Third acquirer 116 is the main constituent which performs third acquisition step ST6 in the operation analysis method. In the present variation, the attribute information is weather information. The weather information preferably includes at least the weather of the day when the operation of washer 2 is performed. For example, third acquirer 116 acquires, via external network NT1, weather information from a server operated by a service provider which provides weather information.

In planner 113 (plan designing step ST3), further based on the attribute information acquired by third acquirer 116 (third acquisition step ST6), the operation plan is designed. For example, when a plurality of patterns corresponding to a weather forecast are stored in normal operation DB 123, planner 113 designs, based on the weather forecast (attribute information) acquired by third acquirer 116, the operation plan such that any one of the patterns is included. In a specific example, it is assumed that planner 113 designs an operation plan for the subsequent three days and that a first pattern, a second pattern, and a third pattern are stored in normal operation DB 123. The first pattern is a pattern in which when the weather forecast predicts that it is sunny for all the three days serving as the target of the operation plan, the washing operation is performed every day. The second pattern is a pattern in which when the weather forecast predicts that it is rainy on only the first day in the three days serving as the target of the operation plan and it is sunny for the remaining two days, the washing operation is performed on the second day for the clothes of the first and second days. The third pattern is a pattern in which when the weather forecast predicts that it is rainy on the first and second days and it is sunny on only the third day, the washing operation is performed every day. In this case, planner 113 designs, based on the weather forecast for the subsequent three days acquired by third acquirer 116, the operation plan such that one of the first to third patterns is included.

For example, when it is sunny on the day when the operation of washer 2 is performed, planner 113 designs an operation plan such that only the washing operation is performed on that day. For example, when it is rainy on the day when the operation of washer 2 is performed, planner 113 designs an operation plan such that both the washing operation and the drying operation are performed on that day. As described above, in the present variation, it is advantageous to easily design an operation plan further suitable for the user as compared with a case where the attribute information is not referenced.

Figure 8:
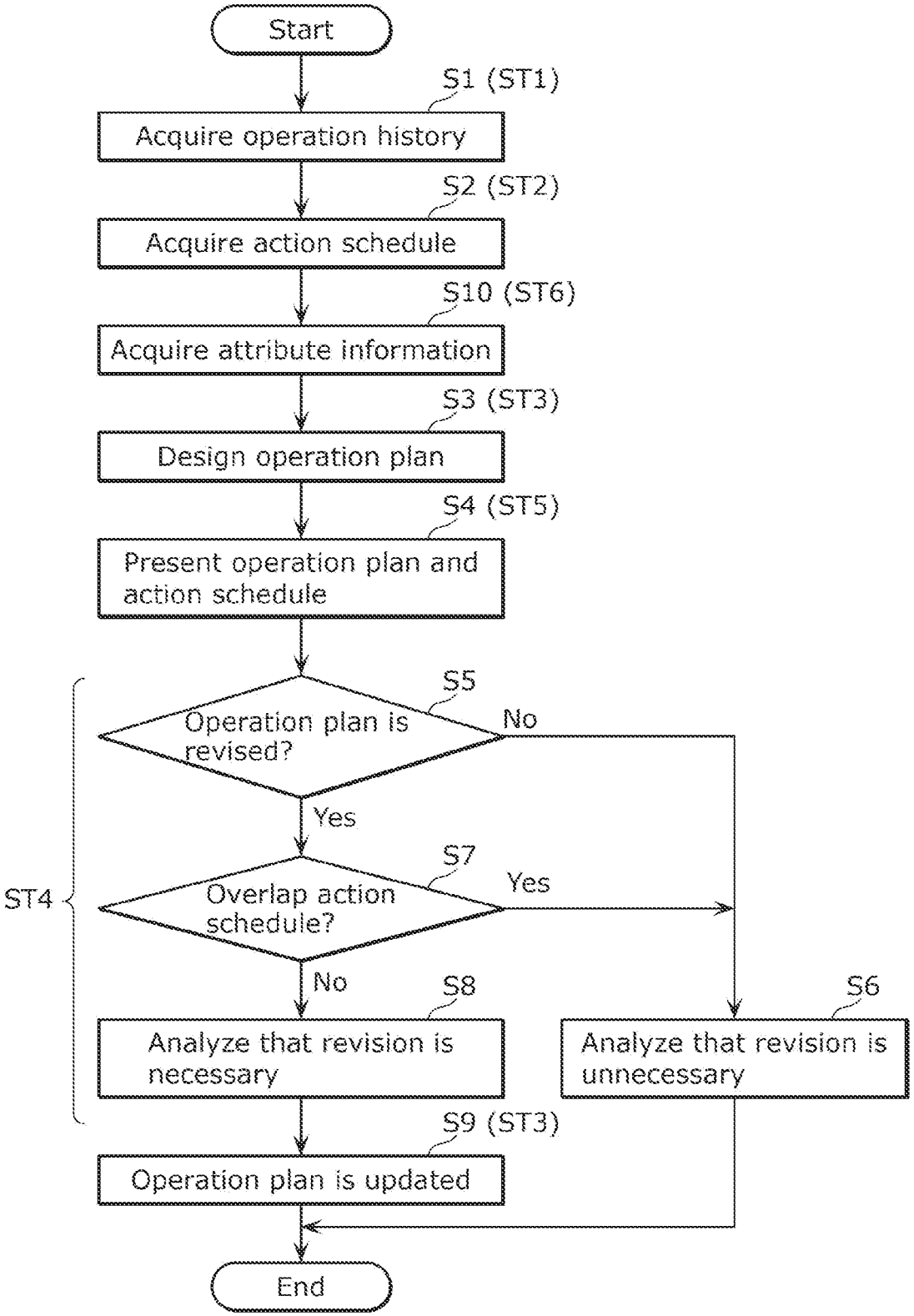
FIG. 8 is a flowchart showing an example of the operation of the operation analysis system in the variation of the embodiment.

FIG. 8 is a flowchart showing an example of the operation of operation analysis system 1A in the variation of the embodiment. As shown in FIG. 8, in the present variation, processing S10 in which third acquirer 116 acquires the attribute information is performed between processing S2 and processing S3. Processing S10 corresponds to third acquisition step ST6 in the operation analysis method. Processing S1 to S3 does not need to be performed in this order or may be performed simultaneously.

Although in the embodiment described above, operation analysis system 1 is formed with the server, the present disclosure is not limited to this configuration. For example, operation analysis system 1 may be incorporated in washer 2. In this case, operation analysis system 1 is preferably formed to be able to communicate with information terminal 3. Moreover, in this case, operation analysis system 1 (washer 2) may be formed to be able to communicate with information terminal 3 by wireless communication in accordance with short-range wireless communication standards such as Bluetooth (registered trademark) without the intervention of external network NT1.

In the embodiment described above, presenter 115 (presentation step ST5) may further present additional information on washer 2 to the user. For example, when the operation history acquired by first acquirer 111 includes the amount of detergent added, operation analysis system 1 can grasp the remaining amount of detergent. In this case, when the remaining amount of detergent is less than or equal to a predetermined amount, presenter 115 may present, to the user, the additional information by displaying, on display 32 in information terminal 3, a message and/or an image for prompting the user to purchase the detergent such as "The detergent will run out in the operation on Wednesday of the next week. Would you like to purchase some detergent?".

In the embodiment described above, analyzer 114 (analysis step ST4) may predict, based on the action schedule acquired by second acquirer 112 (second acquisition step ST2), whether a temporary operation which is irregularly performed by the user occurs. For example, when the action schedule of the user includes an action which is an irregular action such as an athletic meet of a child and in which clothes can become dirty, analyzer 114 may predict that a temporary operation occurs after the action. In this case, planner 113 may update, according to the result of the analysis performed by analyzer 114, the operation plan such that the temporary operation described above is included.

Although in the embodiment described above, the operation plan includes a time of day during which washer 2 performs the operation, the present disclosure is not limited to this configuration. For example, planner 113 designs, in the operation plan, the date on which the operation of washer 2 is performed but does not need to design a time of day during which the operation of washer 2 is performed. In this case, the user starts the operation of washer 2 with arbitrary timing on the day, and thereby can perform the operation of washer 2 suitable for the user, for example, without setting operation parameters.

In the embodiment described above, planner 113 (plan designing step ST3) may design, as the operation plan, an actual operation plan on which the actual date and time is reflected. In other words, when the operation plan is designed, the actual date and time may be reflected.

Although in the embodiment described above, drying function-equipped washer 2 is targeted in operation analysis system 1, the present disclosure is not limited to this configuration. For example, a washer which does not incorporate a dying function may be targeted in operation analysis system 1.

Although in the embodiment described above, presenter 115 (presentation step ST5) presents the operation plan and the action schedule to the user via information terminal 3, the present disclosure is not limited to this configuration. For example, presenter 115 may display the operation plan and the action schedule on a display included in washer 2 to present them to the user. In other words, a device which presents the operation plan and the action schedule to the user is not limited to information terminal 3 and may be washer 2.

For example, although in the embodiment described above, operation analysis system 1 is realized as a single device, operation analysis system 1 may be realized by a plurality of devices. When operation analysis system 1 is realized by a plurality of devices, there is no limitation on how constituent elements included in operation analysis system 1 are allocated to the devices. In other words, the present disclosure may be realized by cloud computing or may be realized by edge computing.

For example, in the embodiment described above, all or part of the constituent elements of operation analysis system 1 in the present disclosure may be formed by dedicated hardware or may be realized by executing a software program suitable for each of the constituent elements. A program executor such as a central processing unit (CPU) or a processor may read and execute a software program recorded in a recording medium such as a hard disk drive (HDD) or a semiconductor memory so as to realize each of the constituent elements.

The constituent elements of operation analysis system 1 in the present disclosure may be formed with one or a plurality of electronic circuits. The one or a plurality of electronic circuits each may be a general-purpose circuit or a dedicated circuit.

In the one or a plurality of electronic circuits, for example, a semiconductor device, an integrated circuit (IC), a large scale integration (LSI) circuit, or the like may be included. The IC or the LSI circuit may be integrated into one chip or may be integrated into a plurality of chips. Although the circuit is referred to as the IC or the LSI circuit here, how the circuit is referred to is changed depending on the degree of integration, and the circuit may be referred to as a system LSI circuit, a very large scale integration (VLSI) circuit, or an ultra large scale integration (ULSI) circuit. A field programmable gate array (FPGA), which is programmed after the manufacturing of its LSI circuit, can be used for the same purpose.

The general or specific aspects of the present disclosure may be realized by a system, a device, a method, an integrated circuit, or a computer program. The general or specific aspects may also be realized by a non-transitory computer-readable recording medium such as an optical disc, a HDD, or a semiconductor memory in which the computer program is stored. For example, the present disclosure may be realized as a program for causing a computer to execute the control method in the embodiment described above. The program may be recorded in a non-transitory computer-readable recording medium such as a CD-ROM or may be distributed via a communication path such as the Internet.

As described above, as an example of the technology in the present disclosure, the embodiment has been described. For this purpose, the accompanying drawings and the detailed description are provided.

Hence, constituent elements provided in the accompanying drawings and the detailed description can include not only constituent elements which are essential for solving the problem but also constituent elements which are intended for illustrating the technology and are not essential for solving the problem. Therefore, it should not be assumed that since the constituent elements which are not essential are provided in the accompanying drawings and the detailed description, the constituent elements which are not essential are essential.

Since the embodiment described above is intended for illustrating the technology in the present disclosure, it is possible to perform various types of change, replacement, addition, omission, and the like in the scope of claims or in a scope equivalent thereto.

(Conclusions)

As described above, the operation analysis method in the embodiment includes first acquisition step ST1, second acquisition step ST2, plan designing step ST3, and analysis step ST4. In first acquisition step ST1, the operation history of washer 2 is acquired. In second acquisition step ST2, at least the action schedule of the user of washer 2 is acquired. In plan designing step ST3, based on the operation history acquired in first acquisition step ST1, an operation plan for the future regarding the normal operation of washer 2 periodically performed by the user is designed. In analysis step ST4, based on the action schedule acquired in second acquisition step ST2, whether the operation of washer 2 is the normal operation is analyzed. In plan designing step ST3, the operation plan is updated based on the result of the analysis in analysis step ST4.

In this way, since whether the operation of washer 2 is the normal operation is analyzed based on the action schedule of the user, it is advantageous to easily grasp the aspect of the operation of washer 2 performed by the user.

For example, the operation analysis method further includes presentation step ST5 for presenting, to the user, the operation plan designed in plan designing step ST3 and the action schedule acquired in second acquisition step ST2.

In this way, since the user can grasp the operation plan, it is advantageous that, for example, the operation of washer 2 which is not desired by the user is prevented from being performed and thus the convenience of the user is easily enhanced.

For example, in presentation step ST5, the operation plan and the action schedule in a predetermined period are presented to the user.

In this way, since the user can collectively grasp the operation plan and the action schedule in the predetermined period, it is advantageous that the convenience of the user is easily enhanced.

For example, the operation plan includes a time of day during which washer 2 performs the operation.

In this way, since the user easily grasps a time of day during which washed clothes are hung, it is advantageous that the convenience of the user is easily enhanced.

For example, in presentation step ST5, additional information on washer 2 is further presented to the user.

In this way, since the user checks, for example, additional information for prompting the user to purchase a detergent, it is advantageous that the convenience of the user is easily enhanced.

For example, in analysis step ST4, based on the result of a revision made by the user to the operation plan presented in presentation step ST5, whether the operation of washer 2 is the normal operation is analyzed.

In this way, it is advantageous that as compared with a case where the result of a revision made by the user is not used, the accuracy of analysis as to whether the operation of washer 2 is the normal operation is easily enhanced.

For example, the operation analysis method further includes third acquisition step ST6 for acquiring attribute information on the operation of washer 2. In plan designing step ST3, further based on the attribute information acquired in third acquisition step ST6, the operation plan is designed.

In this way, it is advantageous to easily design an operation plan further suitable for the user as compared with a case where the attribute information is not referenced.

For example, in analysis step ST4, based on the action schedule acquired in second acquisition step ST2, whether a temporary operation which is irregularly performed by the user occurs is predicted.

In this way, since the user does not need to plan a temporary operation, it is advantageous to be able to expect that the convenience of the user is enhanced.

The operation analysis method in the embodiment includes first acquisition step ST1, plan designing step ST3, and analysis step ST4. In first acquisition step ST1, the operation history of washer 2 is acquired. In plan designing step ST3, based on the operation history acquired in first acquisition step ST1, an operation plan for the future regarding the normal operation of washer 2 periodically performed by the user is designed. In analysis step ST4, based on at least the action schedule of the user of washer 2, whether the operation of washer 2 is the normal operation is analyzed. In plan designing step ST3, the operation plan is updated based on the result of the analysis in analysis step ST4.

In this way, since whether the operation of washer 2 is the normal operation is analyzed based on the action schedule of the user, it is advantageous to easily grasp the aspect of the operation of washer 2 performed by the user.

The program in the embodiment causes one or more processors to execute the operation analysis method described above.

In this way, since whether the operation of washer 2 is the normal operation is analyzed based on the action schedule of the user, it is advantageous to easily grasp the aspect of the operation of washer 2 performed by the user.

Operation analysis system 1 and 1A in the embodiment includes first acquirer 111, second acquirer 112, planner 113, and analyzer 114. First acquirer 111 acquires the operation history of washer 2. Second acquirer 112 acquires at least the action schedule of the user of washer 2. Planner 113 designs, based on the operation history acquired by first acquirer 111, an operation plan for the future regarding the normal operation of washer 2 periodically performed by the user. Analyzer 114 analyzes, based on the action schedule acquired by second acquirer 112, whether the operation of washer 2 is the normal operation. Planner 113 updates the operation plan based on the result of the analysis performed by analyzer 114.

In this way, since whether the operation of washer 2 is the normal operation is analyzed based on the action schedule of the user, it is advantageous to easily grasp the aspect of the operation of washer 2 performed by the user.

The presentation device (information terminal 3 or washer 2) in the embodiment includes a communication function and a presentation function. The communication function is the function of communicating with operation analysis system 1. The presentation function is the function of presenting, when using the communication function to receive signals including the operation plan designed by planner 113 and the action schedule acquired by second acquirer 112, the operation plan and the action schedule to the user.

INDUSTRIAL APPLICABILITY

The present disclosure can be applied to a system which presents an operation plan of a washer to a user and the like.

The invention claimed is:

1. An operation analysis method comprising:

acquiring an operation history of a washer;

acquiring at least an action schedule of a user of the washer;

designing, based on the operation history acquired in the acquiring of the operation history, an operation plan for future regarding a normal operation of the washer periodically performed by the user; and analyzing, based on the action schedule acquired in the acquiring of the action schedule, whether an operation of the washer is the normal operation, wherein the designing includes updating the operation plan based on a result of analysis in the analyzing.

2. The operation analysis method according to claim 1, further comprising:

presenting, to the user, the operation plan designed in the designing and the action schedule acquired in the acquiring of the action schedule.

3. The operation analysis method according to claim 2, wherein in the presenting, the operation plan and the action schedule in a predetermined period are presented to the user.

4. The operation analysis method according to claim 2, wherein the operation plan includes a time of day during which the washer performs the operation.

5. The operation analysis method according to claim 2, wherein the presenting further includes presenting additional information on the washer to the user.

6. The operation analysis method according to claim 2, wherein in the analyzing, whether the operation of the washer is the normal operation is analyzed based on a result of a revision made by the user to the operation plan presented in the presenting.

7. The operation analysis method according to claim 1, further comprising:

acquiring attribute information on the operation of the washer, wherein in the designing, the operation plan is designed further based on the attribute information acquired in the acquiring of the attribute information.

8. The operation analysis method according to claim 1, wherein the analyzing includes predicting, based on the action schedule acquired in the acquiring of the action schedule, whether a temporary operation that is irregularly performed by the user occurs.

9. A non-transitory computer-readable recording medium having a program recorded thereon for causing one or more processors to execute the operation analysis method according to claim 1.

10. An operation analysis method comprising:

acquiring an operation history of a washer;

designing, based on the operation history acquired in the acquiring of the operation history, an operation plan for future regarding a normal operation of the washer periodically performed by a user; and analyzing, based on at least an action schedule of the user of the washer, whether an operation of the washer is the normal operation, wherein the designing includes updating the operation plan based on a result of analysis in the analyzing.

11. An operation analysis system comprising:

a first acquirer that acquires an operation history of a washer;

a second acquirer that acquires at least an action schedule of a user of the washer;

a planner that designs, based on the operation history acquired by the first acquirer, an operation plan for future regarding a normal operation of the washer periodically performed by the user; and an analyzer that analyzes, based on the action schedule acquired by the second acquirer, whether an operation of the washer is the normal operation, wherein the planner updates the operation plan based on a result of analysis performed by the analyzer.

12. A presentation device comprising:

a communication function of communicating with the operation analysis system according to claim 11; and a presentation function of presenting, when signals including the operation plan designed by the planner and the action schedule acquired by the second acquirer are received through the communication function, the operation plan and the action schedule to the user.

* * * * *